US005253384A

United States Patent [19]

Joines et al.

[11] Patent Number: 5,253,384

[45] Date of Patent: Oct. 19, 1993

[54] FLOOR BUFFING MACHINE WITH AUTOMATIC PAD PRESSURE ADJUSTMENT

[75] Inventors: Charles W. Joines, Sparta, N.C.; W. Darrell Ward, Independence, Va.

[73] Assignee: Pioneer/Eclipse Corporation, Sparta, N.C.

[21] Appl. No.: 869,187

[22] Filed: Apr. 16, 1992

[51] Int. Cl.[5] ..... A47L 11/14

[52] U.S. Cl. ..... 15/98; 15/49.1; 51/177

[58] Field of Search ..... 15/98, 50.1, 49.1, 52, 15/87, 180, 355, 356, 385; 51/177; 299/41

[56] References Cited

U.S. PATENT DOCUMENTS

| | | | |
|---|---|---|---|
| 1,688,580 | 10/1928 | Gernandt | 15/49.1 |
| 1,763,365 | 6/1930 | Nobbs | 15/49.1 |
| 2,949,619 | 8/1960 | Holt | 15/49.1 |
| 3,129,539 | 4/1964 | Tempero | 15/49.1 |
| 3,458,885 | 8/1969 | Danielsson | 15/180 |
| 4,358,868 | 11/1982 | Cook, Jr. | 15/49.1 |
| 4,365,377 | 12/1982 | Todd et al. | 15/98 |
| 4,598,440 | 7/1986 | Wilson | 15/98 |
| 4,701,970 | 10/1987 | Wilson | 15/98 |
| 4,739,534 | 4/1988 | Wilson | 15/230.16 |
| 4,845,798 | 7/1989 | Genovese | 15/98 |
| 5,127,124 | 7/1992 | Palmer et al. | 15/49.1 |

*Primary Examiner*—Edward L. Roberts

*Attorney, Agent, or Firm*—Wigman, Cohen, Leitner & Myers

[57] ABSTRACT

An electric buffing machine and a method buffing waxed floors are disclosed. The buffing machine comprises a molded plastic housing, a foldable handle and a DC drive motor directly driving a buffing pad holder. The pad is movable into and out of engagement with the floor by a pad lifter mechanism which raises and lowers the pad holder along a splined drive shaft of the drive motor. The pad lifter mechanism comprises a reversible motor mounted to the housing and connected to the pad holder by means of a threaded output shaft which supports a lifter arm rotatably connected to the pad holder. Rotation of the threaded shaft in one direction or the other moves the lifter arm into which the shaft is threaded together with the pad holder and pad up or down relative to the floor. By observing the current draw of the drive motor, control of pad pressure may be achieved. The pad holder design provides a directed air flow into the housing to collect dust, dirt and debris generated by the buffing operation.

30 Claims, 8 Drawing Sheets

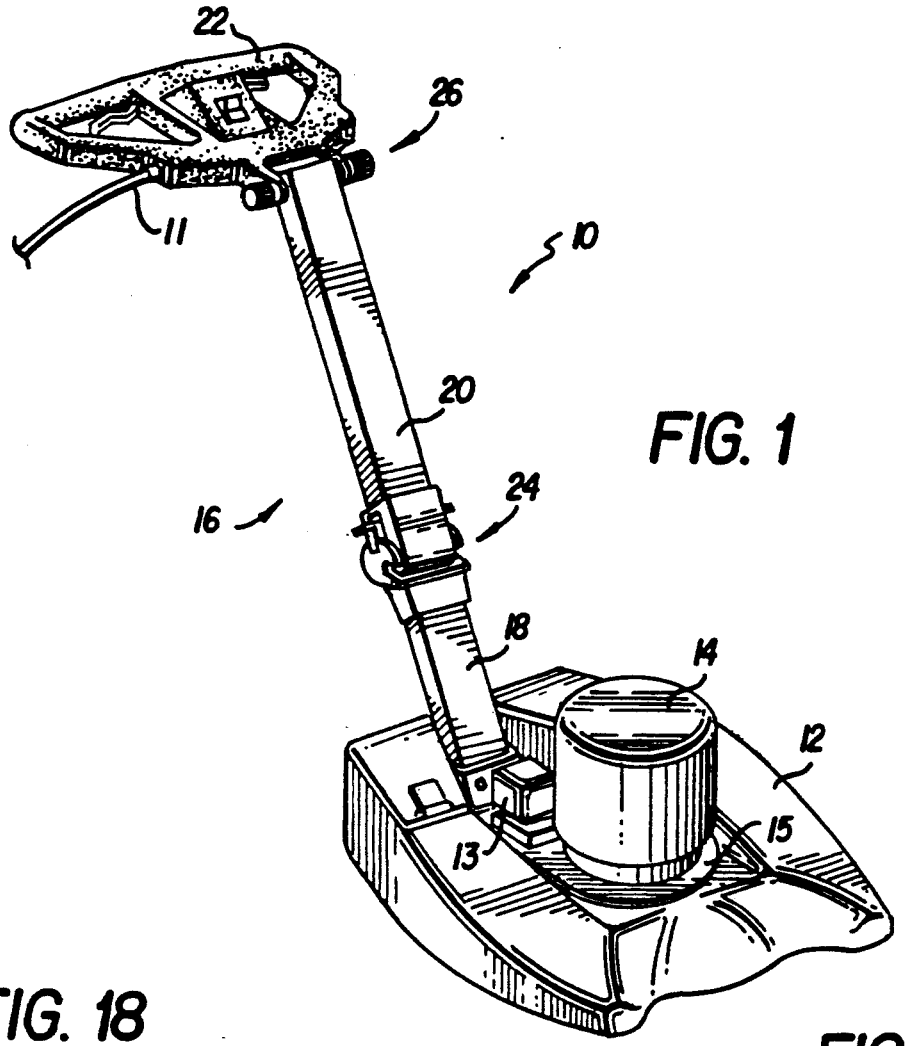
FIG. 1
FIG. 18
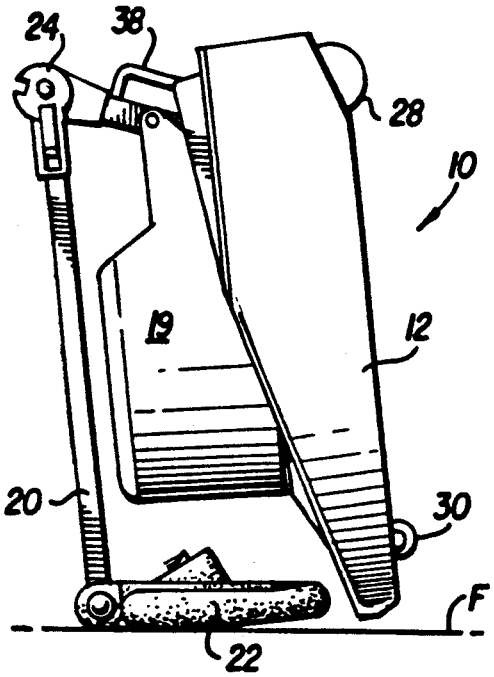
FIG. 19
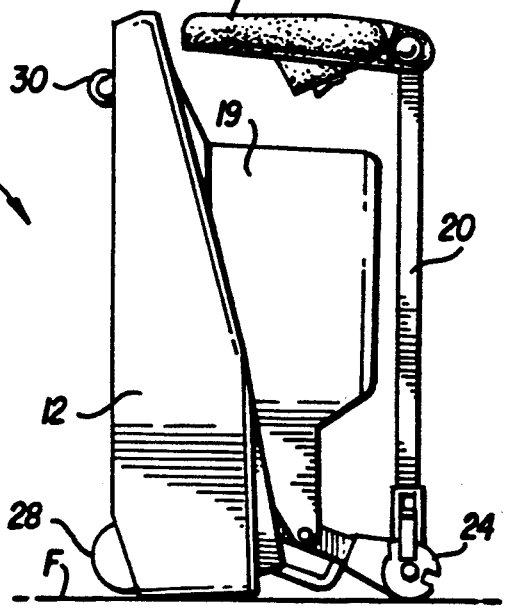

13
50
15
12
82
79
80
52
78
58'
58
14
72
56
6
68
64
74
62
60c
60b
60a
46
71
70
76
60
60d
66
60, 60c
140
142
144
146
148

FLOOR BUFFING MACHINE WITH AUTOMATIC PAD PRESSURE ADJUSTMENT

FIELD OF THE INVENTION

The present invention relates to floor treatment machines and methods, and more particularly to an electric floor buffing machine in which the pressure between the buffing pad and the floor can be automatically adjusted by the user during operation of the buffing machine.

DESCRIPTION OF THE PRIOR ART

Conventional electric floor buffing machines operate at rotational speeds of from about 175 RPM up to about 2000 RPM. At high rotational speeds in the 1500–2000 RPM range, control of buffing pad pressure is especially important for several reasons. First, in order to obtain a high gloss finish, i.e., a "wet look" finish, on a previously waxed floor, especially when dry buffing, it is necessary to create sufficient friction to generate heat and actually melt the top layer of wax on the floor. The friction and the resultant heat generated is proportional to the rotational speed at which the buffing machine operates and the pressure the pad exerts on the floor. Obviously, a low speed machine will require a substantial pressure to create the same amount of heat as a high speed machine. On the other hand, in a high speed machine, a lower pressure is necessary to avoid straining the electric drive motor or causing it to draw excessive current.

One solution for achieving a superior finish on a waxed floor is disclosed in U.S. Pat. No. 4,598,440, which is assigned to the assignee of this invention, and which discloses a high speed buffing machine with an X-shaped buffing pad for developing adequate friction and heat between the buffing pad and floor over a sufficient area without causing undue strain or excessive current draw on the drive motor.

Another approach to controlling the pressure between the buffing pad and floor is disclosed in U.S. Pat. No. 4,845,798. In that patent, a pair of height adjustment wheels are mounted on opposite sides of the base by means of a pivoting axle. A manual adjustment mechanism is provided to vary the height of the wheels and thereby raise and lower the pad with respect to the floor. Other floor buffing machines with adjustment means for transport wheels are disclosed in U.S. Pat. Nos. 2,949,619 and 4,358,868.

Another conventional mechanism for adjusting pad pressure of a floor buffing machine is a manually adjustable caster or wheel on the front of the buffing machine housing for raising and lowering the front portion of the housing relative to the transport wheels.

One of the disadvantages of the aforementioned prior art devices for adjusting the height of the buffing pad or pad pressure is that the buffing pad surface is tilted relative to the floor. Accordingly, pad pressure is applied unevenly to the floor with the greatest pressure being at the forwardmost edge portion on the pad surface. While a large pressure applied over a small area may not cause motor strain or overload, it may create excessive friction and heat in a localized area thereby causing burning of the wax and possible damage to the floor.

Other prior art floor buffing machines rest on the buffing pad during buffing operations and in such machines pad pressure is a function of the weight of the machine and the degree of tilt applied to the machine by the operator during buffing. With such machines pad pressure is highly variable and cannot effectively be reduced below a minimum pad pressure resulting from the weight of the machine. Some machines of this type are provided with wheels which permit the machine to be tilted by pushing the machine handle downwardly to a position below the normal position for operating the buffing machine so that the buffing pad is raised off the floor for transporting the machine.

The floor surfacing machine disclosed in U.S. Pat. No. 1,763,365 has a buffing pad with wings that apply a downward force on the pad proportional to the rotational speed of the pad. Pad pressure is not adjustable without varying the speed of the drive motor.

It would be desirable to provide a floor buffing machine in which the buffing pad could be automatically raised and lowered relative to the floor surface by the operator from his operating position while maintaining the buffing surface of the pad parallel to the floor. Such a machine would provide the operator with complete control of pad pressure during buffing without having to tilt the machine or the buffing pad. It would also be desirable to provide a floor buffing machine in which buffing pad pressure can be automatically adjusted from a zero pressure, i.e., off the floor, to a maximum pressure in which the pad supports essentially the entire weight of the buffing machine.

Advantageously, such a floor buffing machine would provide the machine operator with a method of automatically controlling the magnitude of pad pressure while the machine is operating and without having to turn off the machine to make a manual adjustment of pad height.

SUMMARY OF THE INVENTION

In view of the foregoing limitations and shortcomings of the prior art floor buffing apparatus, as well as other disadvantages not specifically mentioned above, it should be apparent that there exists a need in the art for a floor buffing machine that is capable of automatic pad pressure control by the operator during a buffing operation.

The present invention fulfills that need in the art by providing a floor buffing machine having a machine base or housing supported on a plurality of wheels so as to be spaced a substantially fixed distance off the surface on which it is supported, e.g., a floor to be buffed. A handle is mounted to the housing for use by the operator to direct the buffing machine across a supporting surface and is foldable into a compact storage or carrying position.

An electric drive motor having a driven splined shaft is mounted on the machine housing with the splined shaft extending downwardly through an opening in the housing. A hub having a splined bore is slidably mounted on the splined motor shaft and supports a buffing pad holder on which a buffing pad is removably attached. The hub and pad holder are movable up and down axially on the splined shaft by a pad lifter mechanism. The pad lifter mechanism comprises a lifter arm having two ends. One end of the lifter arm supports a pressed-in antifriction bearing in which the hub is rotatably mounted. The lifter arm extends transversely from the rotational axis of the hub and a threaded insert or threaded bore is provided in the other end of the lifter arm. The lifter mechanism further includes a reversible electric gear motor also mounted on the machine housing with its drive shaft also extending downwardly through an opening in the housing. The gear motor shaft is threaded, preferably with an acme-type thread, and threadably engages the correspondingly threaded insert or bore in the lifter arm.

The reversible gear motor is controlled by the operator from a power switch mounted on the machine handle to rotate the threaded gear motor shaft clockwise or counterclockwise. In one direction of rotation of the gear motor shaft, the lifter arm is driven downwardly carrying with it the hub and pad holder which slide vertically downwardly along the splined shaft of the drive motor until the buffing pad attached to the pad holder engages the floor with the desired pad pressure. In the other direction of shaft rotation, the lifter arm is pulled upwardly to lift the hub and pad holder so that the buffing pad is raised to reduce pad pressure or move the pad completely out of contact with the floor. Limit switches set the uppermost and lowermost limits of travel of the lifter arm and thus the uppermost and lowermost positions of the pad holder.

Since pad pressure is proportional to the electric current draw of the drive motor, control of pad pressure is advantageously achieved by providing a visual indication of motor current, e.g., by an ammeter provided with indicia calibrated in pad pressure magnitude with a maximum pad pressure indicated by a maximum current draw for the motor. Accordingly, during use of the buffing machine according to the method of the invention, the operator automatically controls pad pressure by energizing the gear motor to drive the pad holder downwardly until the visual indicator registers a desired level of pad pressure at which time the operator can deenergize the gear motor. When the buffing operation is completed, the gear motor can be energized to raise the pad holder and buffing pad off the floor surface so that only the machine wheels engage the floor.

The buffing machine of the present invention incorporates a number of additional advantageous constructional features. The housing is preferably molded in one piece of a urethane polymer material loaded with 10–15% by weight of glass microspheres to provide a light weight and resilient, yet high strength, support for the buffing machine components. A prototype of the embodiment of the buffing machine described herein weighs less than 60 lbs. The design of the housing and the foldable handle is such that the buffing machine can be stored in any one of three stable positions with the buffing pad off the floor surface. The foldable handle has two unique pivot joints which are easily operable to fold the handle over the housing into a compact package for shipping, transporting and storage. A lifting handle is provided on the foldable handle to permit the machine to be manually lifted and carried when necessary.

The buffing machine is provided with a unique pad holder and buffing pad combination although other types of pad holders may be used with the buffing machine. For example, the X-shaped pad and pad holder disclosed in U.S. Pat. Nos. 4,598,440; 4,701,970; and 4,739,534 assigned to the assignee of this invention, and incorporated herein by reference, may be used with the buffing machine of this invention.

The machine housing includes a receptacle for a dust nozzle and dust bag for collecting dust generated in the buffing operation. The dust bag is readily accessible for periodic emptying through a hinged cover on the top of the housing. The preferred wheel configuration for supporting the housing comprises four wheels, including two rear wheels on a fixed axle and two swivel wheels or casters mounted on the front of the housing.

Advantageously, the drive motor and reversible gear motor are mounted on a removable mounting plate so that the entire motor assembly may be removed from the housing. Both motors are also independently mounted to the mounting plate so that each motor may be removed from the mounting plate independently of the other motor.

The pad holder is a shaped substantially circular plate molded of a high impact ABS polymer material. The pad holder is formed with channels and openings for directing air flow through the buffing pad and into the housing above the pad holder. This air flow collects dust from the floor buffing operation and carries it into the dust nozzle and dust bag mounted in the housing receptacle.

With the foregoing and other advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 1 is a perspective view of the floor buffing machine of the present invention shown without the motor cover;

FIG. 18 is a side elevation view of the floor buffing machine of the invention shown in one storage position with the handle folded; and FIG. 19 is a side elevation view of the floor buffing machine of the invention shown in another storage position with the handle folded.

DETAILED DESCRIPTION OF THE INVENTION

Figure 2:
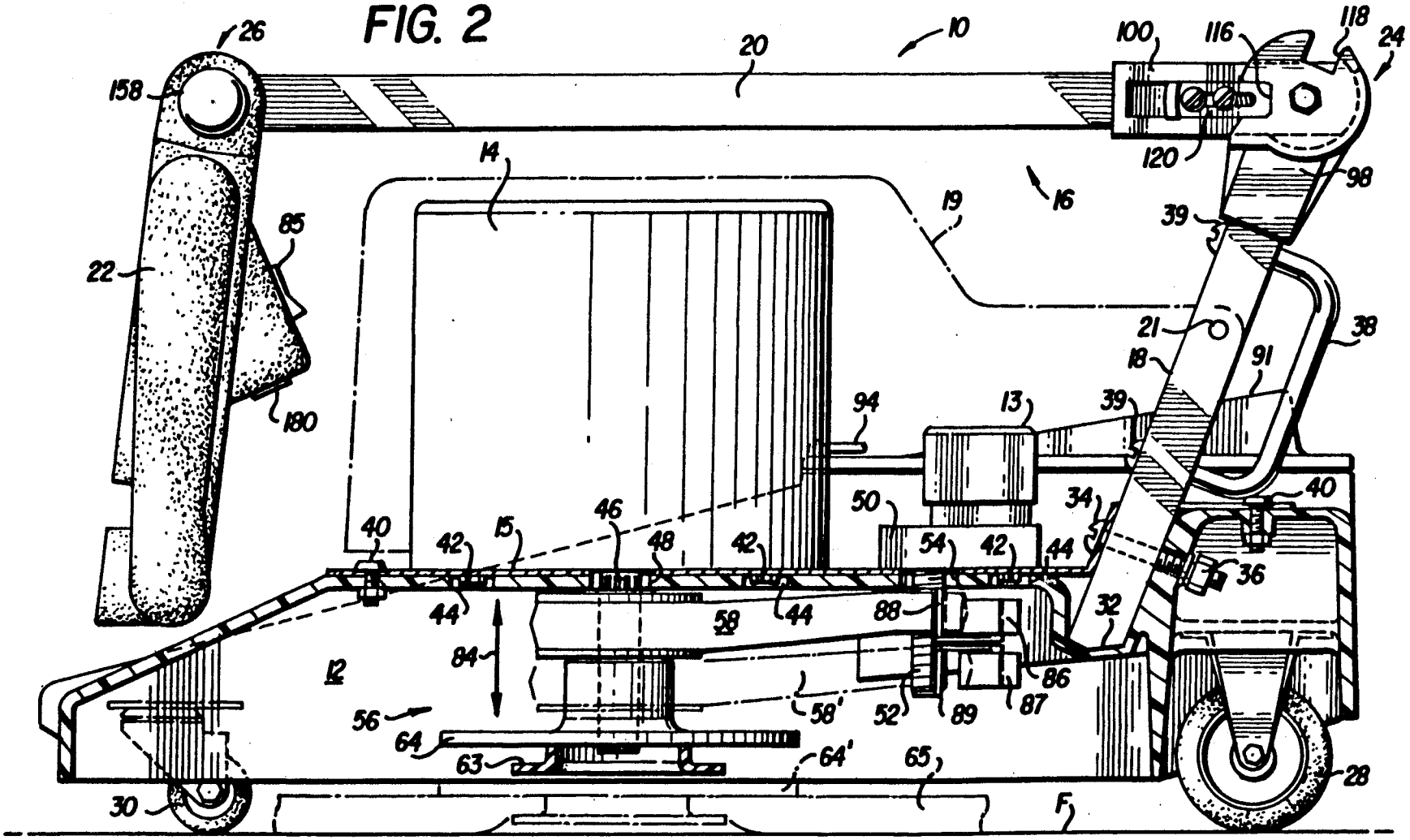
FIG. 2 is a side elevation view, partly in cross-section, of the floor buffing machine of the invention with the handle in its folded or storage position.

Referring now in detail to the drawings, there is illustrated in the perspective view of FIG. 1 the floor buffing apparatus of the present invention which is designated generally by reference numeral 10 and which is shown without a motor cover in place. Apparatus 10 comprises a base or housing 12 preferably molded in one unitary structure of a urethane polymer material filled with 10–15% by weight of glass microspheres. An electric drive motor 14 is mounted to a mounting plate 15 which is, in turn, affixed to the housing 12. The output shaft of motor 14 is directly connected to a buffing pad holder and buffing pad (not shown) supported beneath the housing 12.

Electric drive motor 14 may be any suitable electric motor for the intended purpose, such as a 1.5–2.0 hp DC motor. A preferred motor according to the present invention is a 1.5 hp DC motor made by Ohio Electric Motors, Barnardsville, N.C. under the designation Model No. A-183270X9190 and having a splined output drive shaft. This motor operates at about 2000 RPM from a standard 110 volt residential or commercial power source and draws a full load current of about 15 amperes. A reversible gear motor 13 is mounted to mounting plate 15 to the rear of drive motor 14 for a purpose to be hereinafter described.

The floor buffing apparatus 10 is maneuvered about by means of a foldable handle 16 having three major components, a fixed lower handle portion 18, a foldable intermediate handle portion 20, and an upper control handle portion 22. One end of the lower handle portion 18 is rigidly affixed to the housing 12 and the other end thereof is pivotally connected to the intermediate handle portion 20 by means of a first pivot joint 24 having two operative positions, the upright or operating position shown in FIG. 1 and the folded position shown, for example, in FIG. 2. The control handle portion 22 is pivotally connected to the upper end of the intermediate handle portion 20 by means of a second pivot joint 26 which is angularly adjustable to any angular position relative to handle portion 20 within an arc of about 270°–300°.

FIGS. 2–6 illustrate the details of the construction and operation of the floor buffing apparatus 10 of the present invention. Referring first to FIG. 2, the apparatus 10 is shown with the handle 16 in its folded condition. The housing 12 of apparatus 10 is rollably supported at a fixed distance above a floor F by means of a pair of fixed axle rear wheels 28 (only one shown) and a pair of front swivel wheels or casters 30 (only one shown) which are affixed to the housing 12 in molded-in recesses. The lowermost end of the lower handle portion 18 is located in a molded-in recess 32 in the housing 12 and is fixedly secured in place by a pair of fasteners, such as machine bolts 34 and nuts 36. A lifting handle 38 is affixed by bolts 39 to the rear side of handle portion 18 for a purpose to be described. Shown in phantom lines in FIG. 2 is a molded plastic motor cover 19 which encloses the motors 13, 14 and is pivotally mounted to handle portion 18 by a pivot shaft 21. Motor cover 19 is preferably provided with slots (not shown) for allowing cooling air circulation about the electric drive motor 14 and gear motor 13.

Mounting plate 15 is removably fixed to the upper surface of the housing 12 by means of fasteners 40 and the bolts 34 and nuts 36. Drive motor 14 and gear motor 13 are secured to mounting plate 15 by bolts 42 which are accessible via clearance holes 44 from the underside of housing 12. This fastening arrangement advantageously permits the mounting plate 15, together with the motors 13, 14 to be attached to and removed from the housing 12 as a unitary assembly, and also permits each motor 13, 14 to be removed and replaced independently of the other motor and the mounting plate 15.

Drive motor 14 has a splined output shaft 46 which extends through aligned openings 48 in the mounting plate 15 and housing 12. In a similar manner the gear motor 13, which includes a gear reducer 50, has a threaded output shaft 52 which extends through aligned openings 54 in the mounting plate 15 and housing 12. Preferably, gear motor 13, and gear reducer 50 is a reversible 20 lb.-in. AC motor/gearbox combination manufactured by Molon Motor & Coil Corporation, Rolling Meadows, Ill. 60008 under the designation QHM-5063-X. Motor 13 is operable from a 110 volt AC source and the output shaft 52 of motor 13 is threaded with a ⅝ inch–8 acme thread.

The hub assembly 56 of a pad holder is mounted on splined shaft 46 for sliding vertical (axial) movement and is vertically supported for rotatable movement with shaft 46 by a pad lifter mechanism comprising a lifter arm 58 supported in cantilever fashion by the threaded shaft 52 of gear motor 13. Lifter arm 58 is preferably cast of aluminum or an aluminum-zinc alloy, but may be made of other suitable materials, including metallic materials such as steel or plastic materials.

Figures 5, 6, 12:
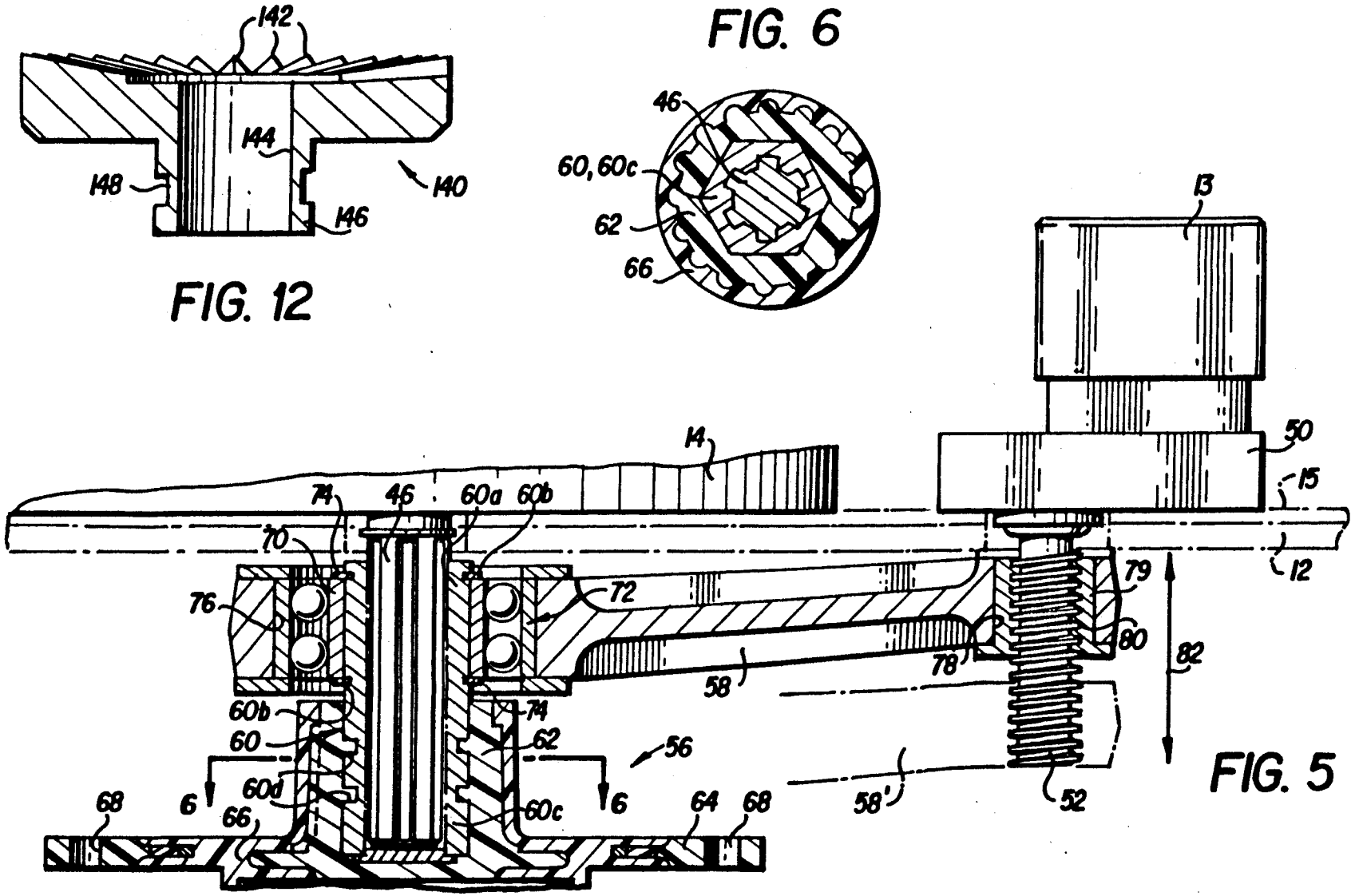
FIG. 5 is an enlarged detail view, partly in cross-section, of the pad lifter mechanism of the present invention.
FIG. 6 is a cross-sectional view taken along line 6—6 in FIG. 5.
FIG. 12 is a cross-sectional view of a star-lock component of the pivot joint of FIG. 9.

The operation of the pad lifter mechanism can be best understood by referring to FIGS. 5 and 6. The pad holder hub 56 comprises a splined hub 60 having an upper cylindrical portion 60*a* provided with a pair of annular grooves 60*b* and a lower hexagonal portion 60*c* also provided with annular grooves 60*d*. The lower hexagonal portion 60*c* of the splined hub 56 has a plastic hub insert 62 molded thereon. A pad holder mounting ring 64, made of a relatively rigid plastic material, such as nylon, is encapsulated with the hub insert 62 with a resilient polyurethane connecting part 66. Mounting ring 64 is provided with holes 68 for securing a suitable pad holder to the hub 56, such as, for example, the pad holder shown herein in FIGS. 15–16. Of course, other pad holders may be secured to the mounting ring 64, such as the X-pad holders described in U.S. Pat. No. 4,701,970 assigned to the assignee of this invention or the pad holder described in copending U.S. patent application Ser. No. 07/820,003 filed Jan. 13, 1992, and also assigned to the assignee of this invention.

The upper cylindrical portion 60*a* of splined hub 60 is pressed into the inner race 70 of an antifriction ball bearing 72 and is secured therein by retainer rings 74 inserted in grooves 60*b*. Bearing 72 is pressed into a bore 76 in one end of lifter arm 58 such that the hub assembly 56 is rotatable with shaft 46 relative to the lifter arm. The other end of lifter arm 58 is provided with a bore 78 for receiving a pressed-in steel insert having an internal bore provided with an acme thread 80 complementary to the thread on shaft 52.

The pad lift mechanism including lifter arm 58 shown in solid lines in FIGS. 2 and 5 depicts the uppermost position of the pad holder hub 56 in which the pad holder and buffing pad are raised above the floor F in non-contacting or spaced relation thereto. The position of the lifter arm shown in phantom lines 58' in FIGS. 2 and 5 and the mounting ring 64' in FIG. 2 depict the lowermost position of the pad holder hub 56 and pad holder mounting ring 64. In the lowermost position of hub assembly 56, a buffing pad 65, partly shown in phantom lines in FIG. 2, will be in operative, contacting relation with the floor F.

Operation of the reversible gear motor 13 in one direction or the other drives the threaded insert 79 upwardly or downwardly as shown by double-headed arrow 82 in FIG. 5. This up and down movement of the insert 79 drives the lifter arm 58 and hub assembly 56 up and down a corresponding distance as shown by the double-headed arrow 84 in FIG. 2. It has been found according to the present invention that, so long as the hub assembly 56 is rotated, even at a minimal RPM, e.g., 5–10 RPM, the splined hub 60 will not bind on splined shaft 46 when the lifter arm 58 is driven up and down by the threaded shaft 52 of gear motor 13.

The gear motor 13 is controlled by a switch 85 mounted on upper handle portion 22 so as to be readily accessible to the machine operator during a buffing operation to vary the pressure of the buffing pad 65 on the floor F, or to raise the buffing pad off the floor F at the completion of an operation, or when transporting the apparatus to and from the work location. Advantageously, it is unnecessary to tilt the floor buffing machine of the present invention to raise the buffing pad off the floor as is required in many prior art machines. Tilting of the prior art machines is usually accomplished by pushing down on the handle and holding it at lower height, making it difficult and awkward for the operator to transport the machine in such tilted position. With the apparatus of the present invention, the operator may adjust the angle of the upper handle portion to a desired position most comfortable for the operator and keep the handle in that position for buffing and transporting.

Referring again to FIG. 2, a pair of electrical limit switches 86, 87 are mounted to the underside of housing 12 for interrupting power to the gear motor 13 when the lifter arm 58 reaches positions of maximum upper and lower limits of travel. The upper and lower limits are set by contact elements 88, 89, respectively, which are connected to limit switches 86, 87.

Figure 3:
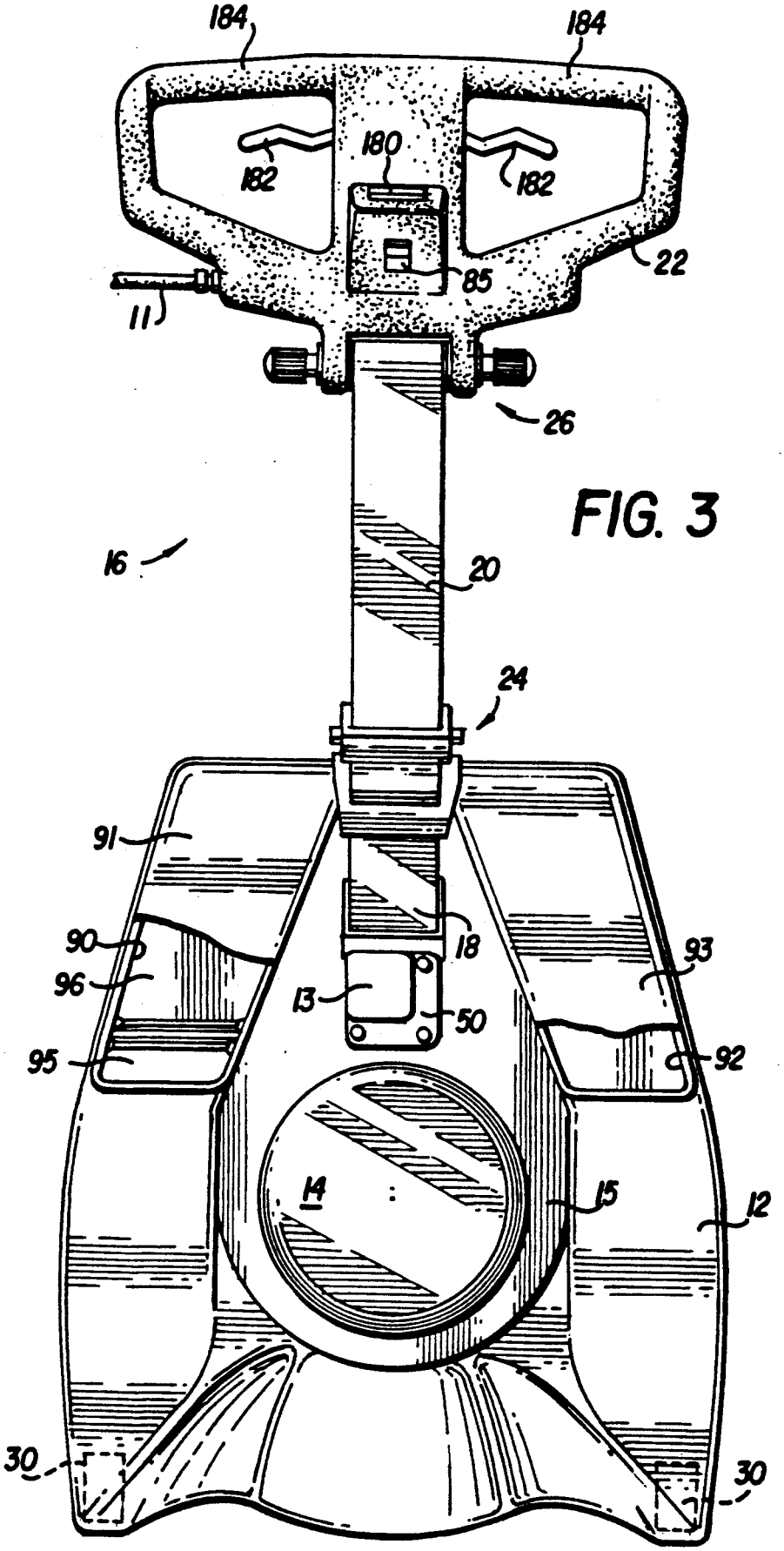
FIG. 3 is a top plan view of the floor buffing machine of the present invention.
Figure 4:
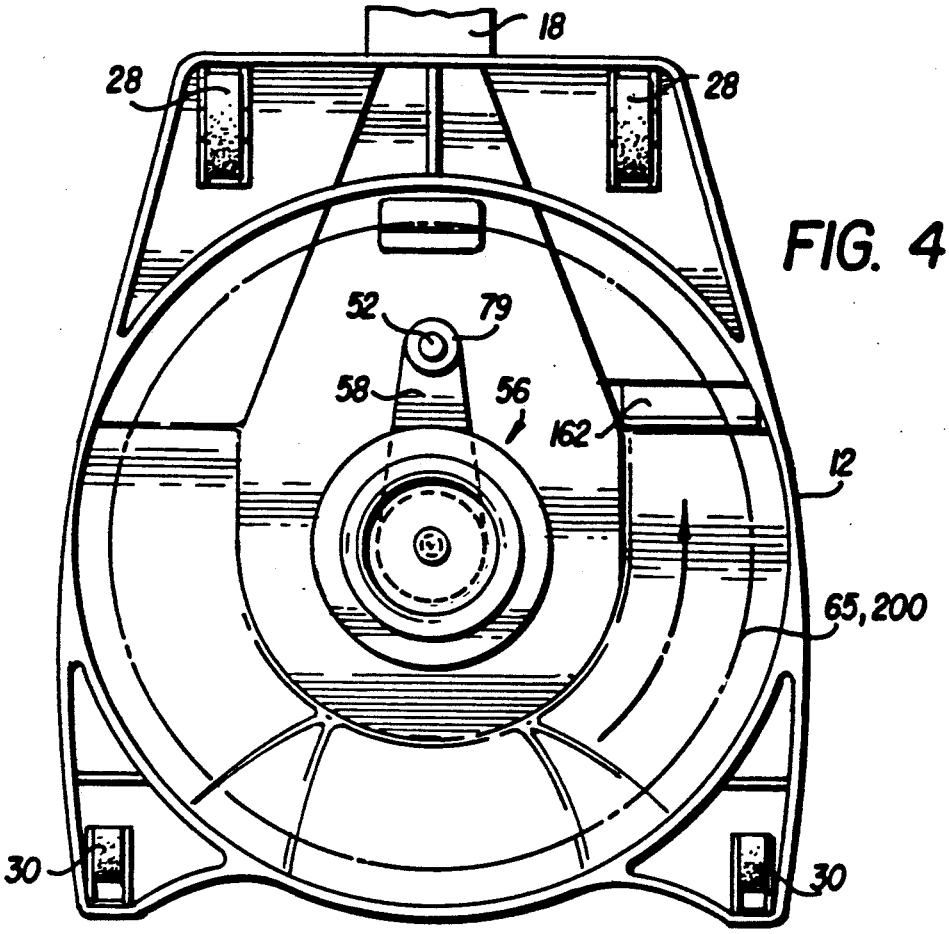
FIG. 4 is a bottom view of the machine housing of the invention.

FIG. 3 is a top view of the buffing apparatus 10 illustrating the location of two receptacles 90, 92 molded into the rear part of the housing 12. Each receptacle is provided with a cover 91, 93 each hingedly connected at the rear side thereof with a hinge (not shown) biased with a spring toward the open position. The covers 91, 93 are retained over the receptacles 90, 92 by a suitable fastener, such as a quarter-turn fastener 94 (FIG. 2). Receptacle 92 houses some of thee electrical components (not shown) of the apparatus. Receptacle 90 contains a dust nozzle 95 and dust bag 96 which are illustrated and described in greater detail hereinafter in connection with FIGS. 13 and 14.

Figure 7:
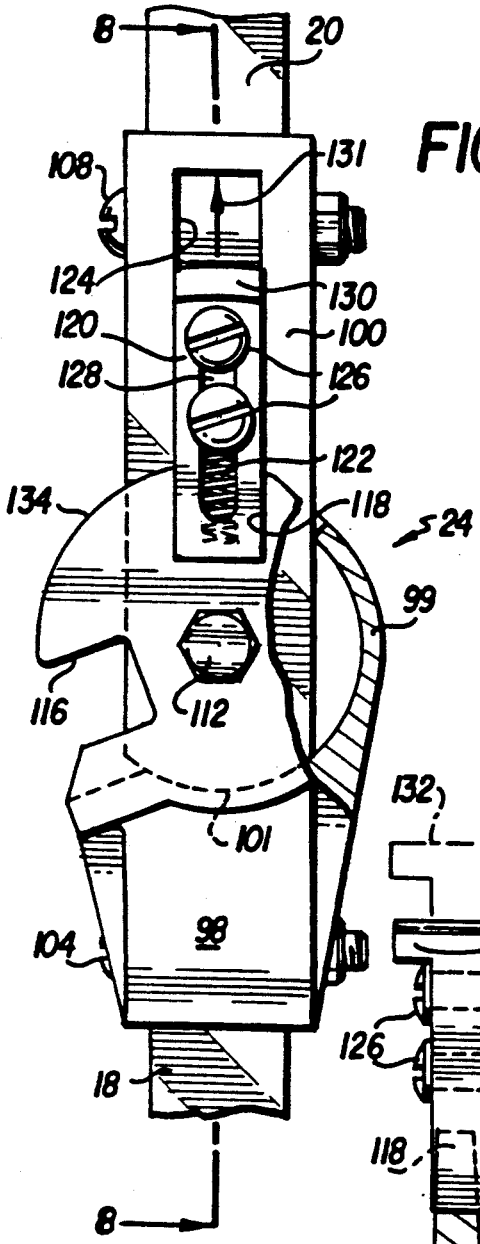
FIG. 7 is a fragmentary side elevation view of one of the pivot joints on the foldable handle of the buffing machine invention.
Figure 8:
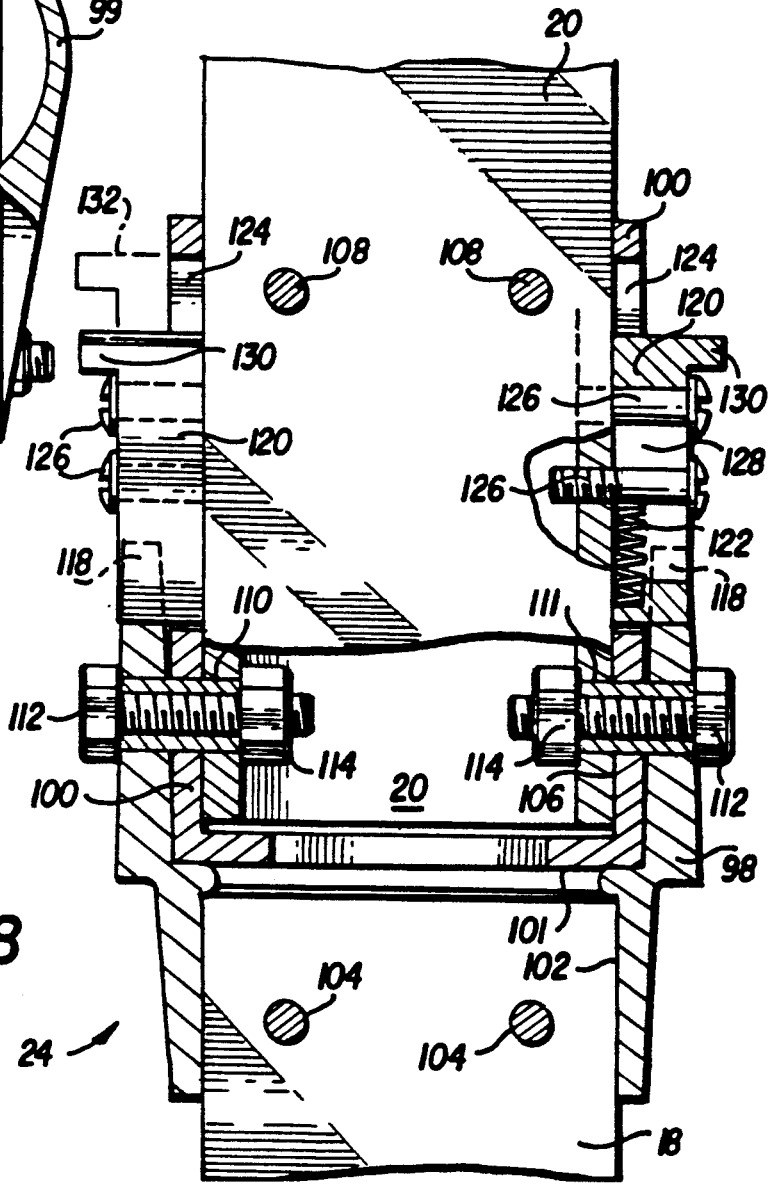
FIG. 8 is a fragmentary cross-sectional view of the pivot joint of FIG. 7 taken along line 8–8 of FIG. 7.

FIGS. 7 and 8 illustrate the first or handle lock pivot joint 24 between the fixed lower handle portion 18 and the intermediate handle portion 20. The handle lock pivot joint 24 comprises two main elements, namely, the handle lock pivot socket 98 and the handle lock pivot ball 100. Handle portion 18 is fitted into a rectangular receptacle 102 of pivot socket 98 and is secured therein by a pair of fasteners such as bolts and nuts 104. Handle portion 20 is slidably fitted into a rectangular receptacle 106 in pivot ball 100 and is secured therein by a pair of bolts and nuts 108. A pair of pivot means comprising a pair of pivot sleeves or bushings 110, 111 extend through aligned openings in pivot socket 98 and pivot ball 100/handle portion 20. Bushings 110, 111 are retained in place by threaded bolts 112 and nuts 114. Although the pivot means may be in the form of a single pivot pin passing through all aligned openings and retained therein by retainer rings or the like, the pivot bushings 110, 111 and retaining bolts 112 and nuts 114 are preferred so as to maintain a clear throughpassage along the hollow handle portions 18, 20 for the free passage of electrical wiring through the handle.

As best seen in FIG. 7, pivot socket 98 has two pair of recesses 116, 118 into one or the other pair of which handle lock levers 120 are resiliently biased by springs 122. Levers 120 are slidably disposed in rectangular cutouts or guideways 124 on opposite sides of pivot ball 100 and are each retained in a respective guideway 124 by a pair of screws 126 threaded into handle portion 20 and extending through longitudinal slots 128 in levers 120 as best seen in FIG. 8. Levers 120 are preferably molded of a plastic material, such as nylon, with projections 130 extending outwardly therefrom.

In the position shown in FIGS. 7 and 8, the handle lock pivot joint 24 is set in its erect or operating position shown in FIG. 1 with the levers 120 engaged in recesses 118. To pivot the joint 24 and fold the handle 16 to the position shown in FIG. 2, the levers 120 are both manually grasped by the projections 130 and lifted in the direction of arrow 131 (FIG. 7) to the position shown by phantom lines 132 (FIG. 8) to thereby disengage the levers 120 from recesses 118 and compress springs 122. Handle portion 20 is then pivoted counterclockwise as seen in FIG. 2 about pivot pin 110 until the ends of levers 120 bear on the arcuate surfaces 134 of pivot socket 98 under the force of springs 122. When the levers 120 are aligned with recesses 116, springs 122 urge the levers into recesses 116 and lock the handle portion 20 relative to handle portion 18 in the position shown in FIG. 2.

As best seen in FIG. 7, the curved end surface 101 of the pivot ball 100 is enclosed by the curved rear portion 99 of pivot socket 98 over the entire angular movement of the handle portion 20. Advantageously, this construction eliminates any pinch points that might otherwise exist between the pivot socket 98 and pivot ball 100.

Figure 9:
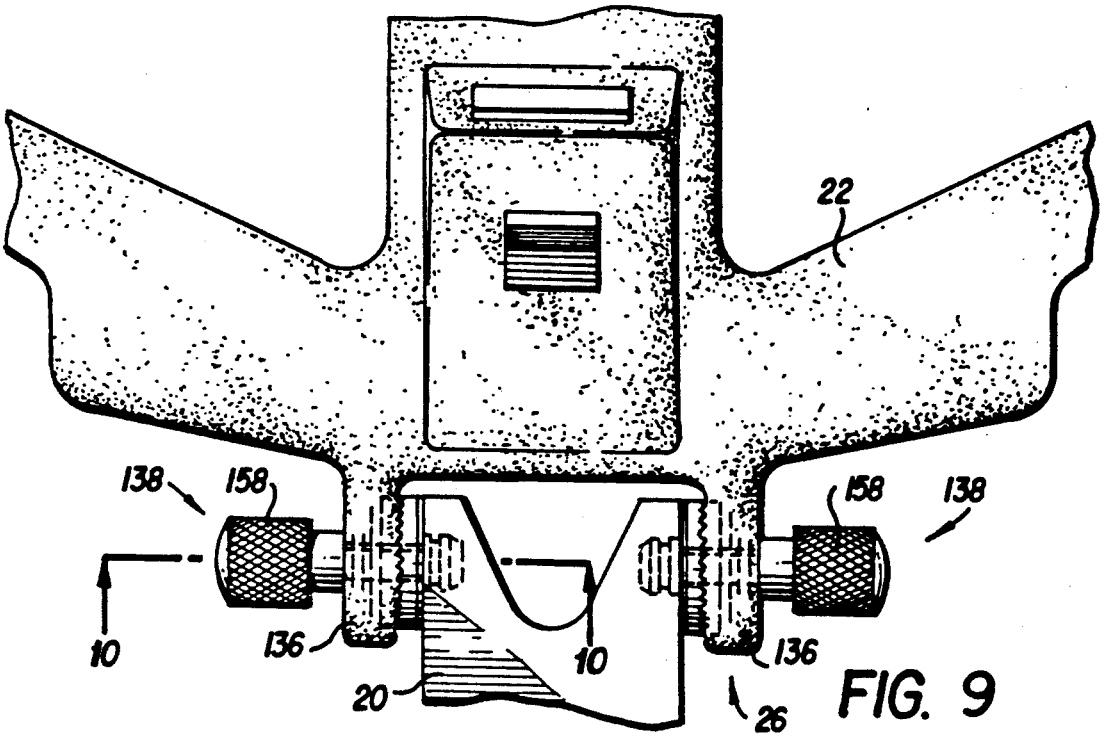
FIG. 9 is a fragmentary top view of a second pivot joint on the foldable handle of the present buffing machine invention.
Figure 10:
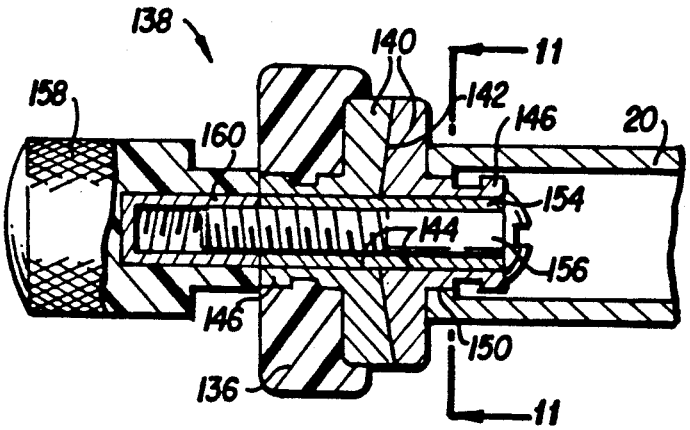
FIG. 10 is a cross-sectional view of the pivot joint of FIG. 9 taken along line 10—10 of FIG. 9.
Figure 11:
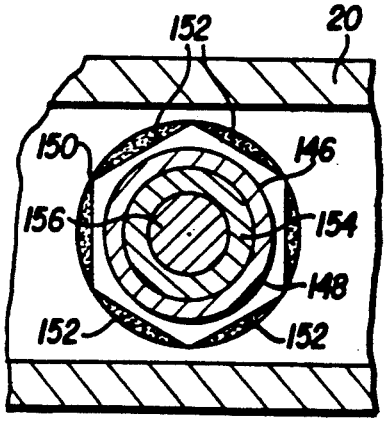
FIG. 11 is a cross-sectional view of a detail of the pivot joint of FIG. 9 taken along line 11—11 of FIG. 10.

FIGS. 9–12 illustrate the construction of the second pivot joint 26 between the intermediate handle portion 20 and the upper control handle portion 22. Handle portion 22 is preferably molded of a plastic material with a pair of arms 136 each of which is connected to handle portion 20 by a star lock pivot 138, the construction of which is best shown in FIG. 10. Each pivot 138 comprises a pair of star lock elements 140 (FIG. 12) made of aluminum, an aluminum alloy or steel and having a plurality of radial teeth 142 with a triangular cross-section such that when the teeth 142 of two star lock elements 140 are interengaged as shown in FIGS. 9 and 10, the pivot joint 26 is prevented from pivoting movement. When the teeth 142 are substantially disengaged, the star lock elements can be rotated relative to one another.

The star lock elements 140 are provided with a central through bore 144 and an anchoring member 146 having a hexagonal cross-section (FIG. 11) and an annular groove 148. Star lock elements 140 are molded in place in the plastic arms 136 of handle portion 22 such that each anchoring member 146 with its hexagonal cross-section and annular groove 148 is rigidly affixed in a respective arm 136. Similarly, the anchoring members 146 are inserted in circular bores 150 (FIG. 11) on opposite sides of the handle portion 20 so as to leave spaces for welds 152 between the hexagonal cross-section of member 146 and the circular bore 150 to facilitate welding of the star lock element 140 to the handle portion 20.

With the two pair of star lock elements 140 molded in the arms 136 and welded in the handle portion 20, the bores 144 of the elements 140 are aligned and a sleeve bushing 154 is inserted into the bores 144. A threaded pivot screw 156 is inserted through the sleeve bushing 154 and into a knurled knob 158 having a female threaded steel insert 160 molded therein.

Those skilled in the art will appreciate that when the knobs 158 are loosened or unthreaded, the resiliency of the arms 136 will permit the teeth 142 of the star lock elements 140 to disengage to some extent so that the handle portion 22 can be rotated about the axes of pivot screws 156 to a desired angular position relative to handle portion 20, e.g., the position shown in FIG. 1. Then, the knobs 158 are manually tightened to the position shown in FIG. 10 to fully engage the teeth 142 and lock the pivot 138 against rotation. When it is desired to store the buffing apparatus 10, the handle portion 22 is positioned relative to the handle portion 20 as shown in FIG. 2 and the knobs 158 are tightened.

With the handle 16 folded to its position shown in FIG. 2, the buffing apparatus 10 may be stored in this position with the buffing pad 65 raised off the floor F. The apparatus 10 may also be stored in the positions shown in FIGS. 18 and 19 resting either on the handle portion 22 and the front of housing 12 (FIG. 18) or on the pivot joint 24 and the rear of housing 12 (FIG. 19). In all three storage positions (FIGS. 2, 18, 19) the apparatus 10 is stable and the buffing pad is advantageously not under compression during storage, which compression could otherwise permanently deform it. Advantageously, the positions of FIGS. 18 and 19 take up less floor space than the FIG. 2 position. In the FIG. 19 position, the apparatus 10 is sufficiently lightweight (less than 60 lbs.) that it can be picked up by lifting handle 38 and carried to a desired location.

Figure 14:
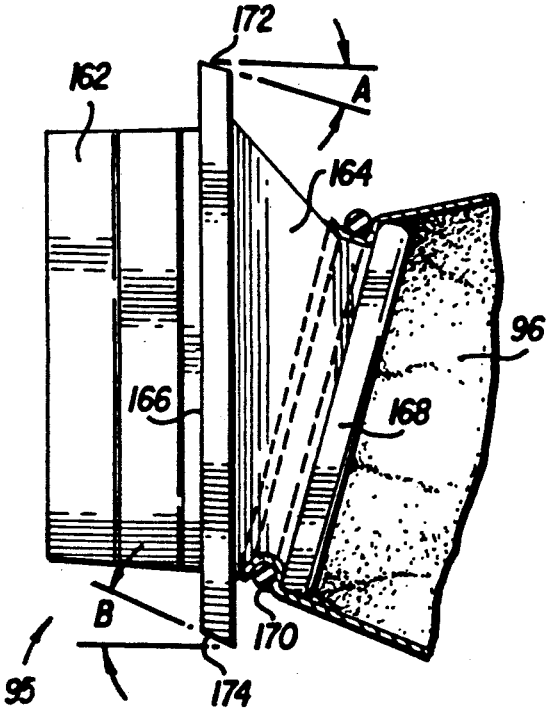
FIG. 14 is a, fragmentary view, partly in cross-section, showing a top view of the dust nozzle with the dust bag connected thereto.
Figure 13:
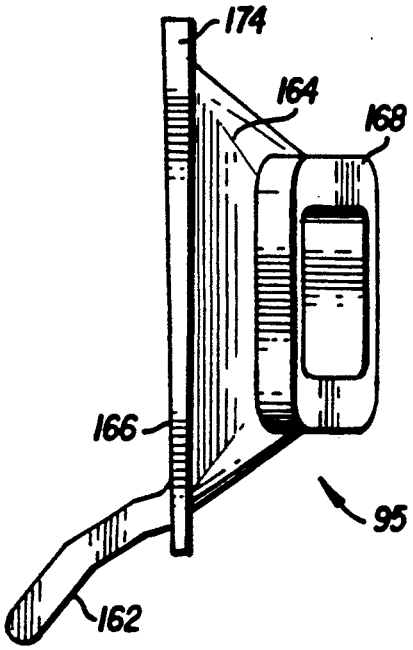
FIG. 13 is a side elevation view of the dust nozzle component of the buffing machine invention.

Referring now to FIGS. 13 and 14, the dust nozzle 95 is formed as a funnel-like member having a downwardly inclined scoop plate 162 which scoops up air and dust generated by the buffing pad and pad holder during a buffing operation and passes it through a converging nozzle throat 164 which is angled off axis from the nozzle inlet flange 166 to the nozzle outlet flange 168 to conform to the angle the receptacle 90 (FIG. 3) is inclined relative to the longitudinal axis of the apparatus 10. Dust bag 96 is releasably affixed to outlet flange 168 of the nozzle 95 by a resilient band 170, such as a rubber O-ring.

The nozzle inlet flange 166 is beveled at different angles A, B (FIG. 14) along its vertical edges 172, 174, respectively. In addition, the vertical edges 172, 174 are tapered from top to bottom as shown in FIG. 13. The beveled and tapered edges 172, 174 advantageously constrain the nozzle 95 to fit into the receptacle 90 in only one orientation as shown in FIG. 3.

Referring to FIGS. 1 and 3, the method of operation of the apparatus will be described. Electrical power from a 110 volt AC source is provided to the apparatus 10 by an electrical cord 11 which enters the handle portion 22 and directs electrical power to the various electrical components by electrical wiring (not shown) in a manner well known and understood by those skilled in the art. Electrical wiring passes down the hollow handle portions 18, 20 and pivot joint 24 and into receptacle 92 from where it is connected to the drive motor 14, gear motor 13 and limit switches 86, 87. An ammeter 180 is mounted on handle portion 22 for measuring the magnitude of the current draw of the drive motor 14. The ammeter reading is a measure of the load on the motor 14 and is thus proportional to the pressure the buffing pad exerts on the floor F. If desired, the ammeter may be calibrated in pad pressure, e.g., low, moderate, heavy, etc., and may also indicate a motor overload condition.

Assuming the apparatus 10 is configured as shown in FIG. 1 with the buffing pad raised above the floor F. Power from electrical cord 11 is directed to drive motor 14 when the operator grasps one or both of the levers 182 (FIG. 3) and urges it rearwardly against the bars 184 of handle portion 22. When drive motor 14 is energized and the buffing pad begins to rotate, the operator activates switch 85 to lower the buffing pad with gear motor 13 and observes the reading on ammeter 180 until the desired current or pad pressure is reached, at which time he releases switch 85 and carries out the buffing operation. During the buffing operation, a reduction in pad pressure may signify pad wear or deterioration. Pad pressure can be increased by again activating switch 85 to lower the buffing pad further. At the end of the buffing operation, the operator activates the switch 85 to raise the pad holder and buffing pad off the floor F. The buffing apparatus 10 may then be transported to storage and stored in any one of the three positions shown in FIGS. 2, 18 and 19.

Figure 16:
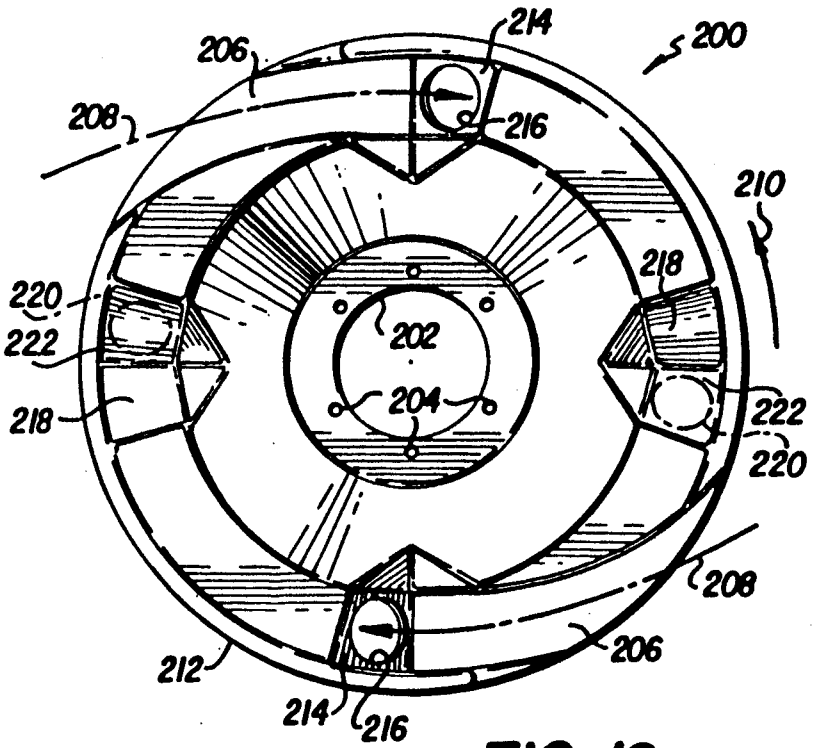
FIG. 16 is a top plan view of the pad holder of FIG. 15.
Figure 15:
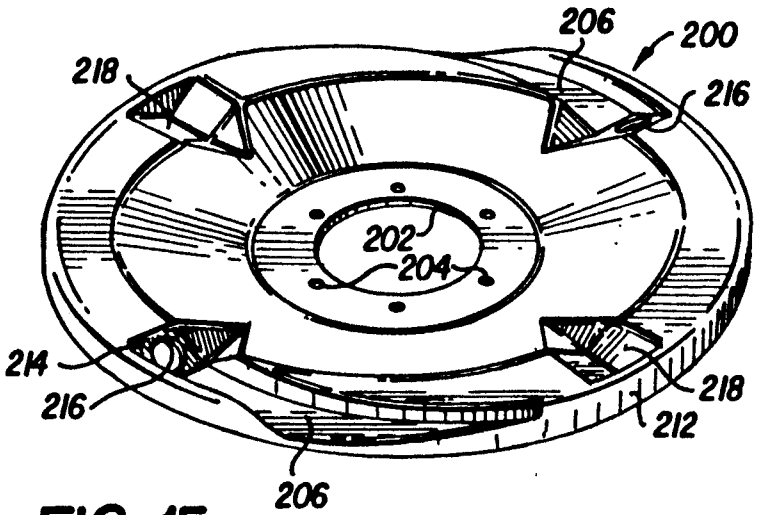
FIG. 15 is a perspective view of the pad holder for use with the floor buffing machine of the invention.
Figure 17:
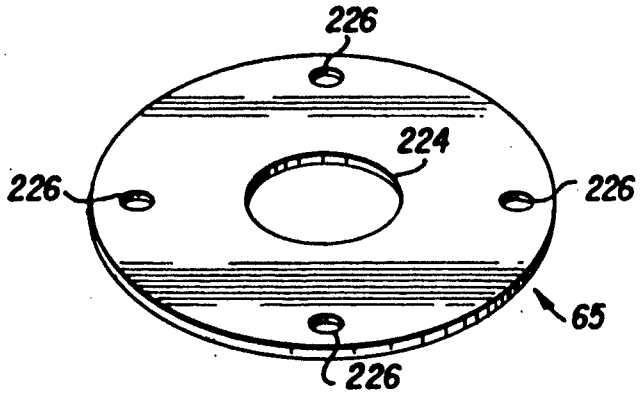
FIG. 17 is a perspective view of a buffing pad used with the pad holder of FIG. 15.

FIGS. 15–17 illustrate one preferred form of a pad holder and buffing pad for the floor buffing apparatus of the present invention, it being understood that other pad holders and buffing pads may be used with the apparatus. Pad holder 200 comprises a circular-shaped disk molded of a high impact ABS plastic material and has a diameter of about 20 inches. A central opening 202 is provided in the pad holder for receiving the pad holder hub assembly 56 (FIGS. 2 and 5). Hub assembly 56 is secured to pad holder 200 by means of fasteners extending through holes 204 in the pad holder 200 which are aligned with holes 68 in the mounting ring 64 of hub assembly 56.

The surface of pad holder 200 shown in FIGS. 15 and 16 is the surface to which a buffing pad is attached, i.e., the lowermost surface. Any suitable attachment means for the buffing pad may be provided, such as the hooks of a hook-and-loop fastener of the type disclosed in the aforesaid copending U.S. patent application Ser. No. 07/820,003. For purposes of clarity, no pad fasteners are shown in FIGS. 15 and 16.

The pad holder 200 is formed with two air intake channels 206 which direct a flow of air along the intake channels in the direction of arrows 208. (FIG. 16) when the pad holder 200 is rotated counterclockwise in the direction of arrow 210 (clockwise as viewed from above the pad holder). Each channel 206 extends somewhat spirally from the outer periphery 212 of the pad holder to an inclined surface 214 in which an air flow passage or opening 216 is provided. Air flow in the clockwise directions 208 passes through passages 216 and continues in a generally curved or circular horizontal path until the flow is deflected upwardly into the interior of housing 12 (downwardly as viewed in FIGS. 15 and 16) by the inclined surfaces 218 located about 75° counterclockwise from the passages 216. The air flow generated in this manner functions to draw loose dirt, dust and debris from the buffing operation up into the housing interior where the scoop plate 162 of dust nozzle 95 (FIGS. 4, 13 and 14) directs the same into the dust bag 96. Thus, the pad holder 200 effectively maintains the buffed floor area relatively free of dirt, dust and debris which might otherwise remain on the floor and possibly mar the high gloss finish on the floor. If greater air flow is required, additional flow passages 220 may be provided in inclined surfaces 222 to augment the air flow through passages 216.

A preferred buffing pad 65 for use with the pad holder 200 is shown in FIG. 17. Buffing pad 65 may be made of any suitable material and is preferably cut from a non-woven mat of rubberized, loosely-spun polyester fibers commonly used as a buffing pad material and readily attachable to the aforesaid hook-type fastener. The pad 65 also has a diameter of about 20 inches and is provided with a central opening 224 which engages over the resilient urethane flange 63 as shown in FIG. 2 in phantom lines. The pad 65 is also preferably provided with four equiangularly spaced holes 226. At least two of the diametrically opposed holes 226 are aligned with the flow passages 216 in pad holder 200 when the pad 65 is attached to the pad holder. The remaining two diametrically opposed holes 226 will be aligned with the additional passages 220 (if provided) in the pad holder 220. Holes 226 in the pad 65 are not essential, especially where a relatively porous buffing pad material is used.

It will be appreciated by those skilled in the art that the floor buffing machine and method of the present invention provide a unique solution to a number of shortcomings of the prior art apparatus and methods. It will also be appreciated that this invention could be applied to other types of rotatable cleaning apparatus for floors, such as scrubbers, strippers, burnishers, polishes and the like.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. Apparatus for treating a floor comprising:
a housing;
wheel means mounted to said housing for rollably supporting said housing on the floor;
handle means connected to the housing for moving the housing over the floor on said wheel means;
a first electric motor mounted on said housing;
holder means mounted for rotational movement to said first motor for supporting a floor treatment element in confronting relation to the floor, said first motor being operative to rotate said holder means and said floor treatment element;
means mounting the holder means to said first motor for vertical movement relative to the floor;
lifter means connected to said holder means for supporting said holder means on said mounting means; and
a second electric motor mounted to said housing and connected to said lifter means for raising and lowering said lifter means relative to the floor so as to engage and disengage the floor with the rotating floor treatment element.

2. Apparatus according to claim 1, wherein said floor treatment is buffing and said floor treatment element is a floor buffing pad.

3. Apparatus according to claim 1, including means for controlling the supply of electrical power to said first and second motors.

4. Apparatus according to claim 3, wherein said second motor is a reversible electric motor, said control means including a switch operative to supply electrical power to said second motor to rotate said second motor in a selected one of two rotational directions.

5. Apparatus according to claim 3, wherein said control means includes means for measuring the electric current draw of said first motor.

6. Apparatus including to claim 3, wherein said control means includes limit switch means for sensing an upper and lower position of said lifter means and for interrupting electrical power to the second . motor when one of said upper and lower positions is sensed.

7. Apparatus according to claim 1, including a mounting plate removably affixed to said housing, said first and second motors being removably affixed to said mounting plate.

8. Apparatus according to claim 1, wherein said housing comprises a one-piece, unitary .molded plastic member.

9. Apparatus according to claim 1, wherein said wheel means comprise a pair of fixed axle rear wheels and a pair of swivel front wheels.

10. Apparatus according to claim 1, wherein said handle means comprises first, second and third handle portions, said first handle portion being fixedly mounted to said housing, first pivot means for pivotally connecting said first and second handle portions about a first pivot axis and second pivot means for pivotally connecting said second and third handle portions about a second pivot axis, said handle means having an operating position and a folded position.

11. Apparatus according to claim 10, wherein said handle means is foldable between said operating position and said folded position, the apparatus having three storage positions when said handle is in the folded position comprising a first storage position resting upon a first end of the housing and the first handle portion, a second storage position resting upon the wheel means and a third storage position resting upon a second end of the housing and the third handle portion.

12. Apparatus according to claim 10, including a lifting handle mounted to said first handle portion for lifting the apparatus for transport.

13. Apparatus according to claim 10, wherein said first pivot means comprises a pivot ball member pivotally connected to a pivot socket member for rotation about said first pivot axis, said first handle portion being mounted to said pivot ball member and having at least one spring-biased lever slidably mounted thereon, said pivot socket member having at least first and second recesses angularly spaced about said first pivot axis, said lever being slidably engageable in said first recess in the operating position of the handle means and being slidably engageable in said second recess in the folded position of the handle means.

14. Apparatus according to claim 13, wherein said first pivot ball member has a slot for guiding said lever, said ball member and said socket member being pivotally connected on said first pivot axis by at least two independent pivots.

15. Apparatus according to claim 10, wherein said second pivot means comprises at least first and second star lock members each having a plurality of teeth, the teeth of the first star lock member being in confronting relation with the teeth of the second star lock member, said first star lock member being affixed to the second handle portion and the second star lock member being affixed to the third handle portion such that said star lock members are relatively rotatable about said second pivot axis and means for engaging the teeth of the star lock members so as to lock the star lock member in non-rotatable relation about said second pivot axis.

16. Apparatus according to claim 15, wherein said first and second star lock members are substantially identical, each star lock member having a central bore and an anchoring member having a hexagonal cross-section and an annular groove therein.

17. Apparatus according to claim 16, wherein said third handle portion comprises a molded plastic handle with at least one arm, the anchoring member of said first star lock member being integrally molded in said arm, said second handle portion having a bore, the anchoring member of said second star lock member extending into said bore and being welded to said second handle portion.

18. Apparatus according to claim 15, wherein each star lock member has a central bore, a pivot member extending through said central bores, said pivot member comprising a bushing and a threaded bolt extending through said bushing, said means for engaging the teeth of the star lock members in non-rotatable relation comprising a knob member threaded onto said bolt for urging the star lock members toward one another until the teeth thereof engage.

19. Apparatus according to claim 1, wherein said holder means comprises a buffing pad holder, said buffing pad holder comprising a molded disk having first and second sides, said disk having at least one air flow channel molded in the first side thereof, said air flow channel comprising an inclined wall at one extremity thereof with a flow passage disposed in said inclined wall for the passage of air flowing along said channel from the first side of the disk through said flow passage to the second side thereof along a path substantially coplanar with said disk.

20. Apparatus according to claim 19, including two of said air flow channels disposed diametrically opposite one another, and including a further inclined walls formed in said disk in angularly spaced relation to each of the flow passages for deflecting the air flow from said substantially coplanar flow path.

21. Apparatus according to claim 20, wherein said buffing pad holder is mounted to said first motor with the air flow channels and the first side of the disk confronting the floor and the second side of the disk confronting the housing such that, upon rotation of the holder means by the first motor, the air flowing along said channels passes from the first side to the second side of the disk through said passages and is deflected away from the floor whereby dust and dirt are carried with the air flow from the first side to the second side of the disk and means disposed in said housing for collecting the dust and dirt.

22. Apparatus according to claim 21, wherein said collecting means comprises a dust nozzle removably mounted in said housing and a dust bag removably connected to the dust nozzle.

23. A buffing machine for buffing a floor comprising:

a housing having a first electric motor mounted thereon, said motor including a splined drive shaft disposed on a first rotational axis;

means mounted to said housing for supporting said housing relative to the floor;

a buffing pad holder having a splined bore slidably mounted for axial movement on said splined shaft; and lifter means connected to said holder for slidably positioning said holder in a selected axial position along said drive shaft for rotation about said axis, said lifter means further comprising a second motor mounted to said housing and a lifter arm connected between said second motor and said holder.

24. The buffing machine of claim 23, wherein said second motor comprises a reversible electric motor having an output shaft rotatable in opposite directions and disposed along a second rotational axis spaced from the first rotational axis, said lifter arm being connected to said output shaft, said output shaft, in one direction of rotation, moving said holder in a first axial direction along said splined shaft and, in the other direction of rotation, moving said holder in a second axial direction along said splined shaft opposite said first axial direction.

25. The buffing machine of claim 24, including a handle mounted to said housing and control means mounted on said handle for controlling operation of said first and second motors.

26. The buffing machine of claim 25, wherein said control means includes means connected to an electrical circuit for said first motor for indicating the current draw of the first motor, and further including limit switch means for sensing a position of maximum axial movement of said holder in said first and second axial directions and for interrupting electric power to said second motor when the position of the holder is at the maximum axial movement in either of said axial directions.

27. The buffing machine of claim 24, wherein said output shaft of the second motor comprises a helical thread, a threaded bore in said lifter arm threaded onto the thread of said output shaft, the rotation of said output shaft by said second motor being operative to move the lifter arm axially along the output shaft.

28. The buffing machine of claim 24, including an antifriction bearing means disposed between said lifter arm and said holder for rotatably mounting said holder relative to said lifter arm.

29. Apparatus for treating a floor comprising:

a housing;

wheel means mounted to said housing for rollably supporting said housing on the floor;

handle means connected to the housing for moving the housing over the floor on said wheel means;

a first electric motor mounted on said housing, said first motor having a splined drive shaft;

holder means mounted for rotational movement to said first motor for supporting a floor treatment element in confronting relation to the floor, said first motor being operative to rotate said holder means and said floor treatment element, said holder means having a splined bore axially slidable along said splined drive shaft;

lifter means connected to said holder means for supporting said holder means; and a second electric motor mounted to said housing and connected to said lifter means for raising and lowering said lifter means relative to the floor so as to engage and disengage the floor with the rotating floor treatment element, said second motor being a reversible motor and having a threaded drive shaft, said lifter means comprising a lifter arm having first and second ends, said first end being rotatably mounted to said holder means and said second end having a threaded bore, said threaded drive shaft being threadably received in said threaded bore whereby when the threaded drive shaft of said second motor is rotated in one rotational direction, said lifter arm is raised relative to the floor and when the threaded drive shaft of said second motor is rotated in the other rotational direction, said lifter arm is lowered relative to the floor.

30. Apparatus for treating a floor comprising:

a housing;

wheel means mounted to said housing for rollably supporting said housing on the floor;

handle means connected to the housing for moving the housing over the floor on said wheel means;

a first electric motor mounted on said housing, said first motor comprising a DC motor and having a drive shaft;

holder means slidably mounted to said drive shaft for direct rotational drive by the drive of said first motor, said holder means supporting a floor treatment element in confronting relation with the floor, said first motor being operative to rotate said holder means and said floor treatment element;

lifter means connected to said holder means for supporting said holder means; and a second electric motor comprising a reversible gear motor and being mounted to said housing and connected to said lifter means for raising and lowering said lifter means relative to the floor so as to engage and disengage the floor with the rotating floor treatment element.

* * * * *